United States Patent [19]

Kadokura

[11] Patent Number: 4,692,770

[45] Date of Patent: Sep. 8, 1987

[54] VEHICLE WINDOW MOUNT FOR PORTABLE ANTENNA

[75] Inventor: Norihisa Kadokura, Tokyo, Japan

[73] Assignee: Alliance Research Corporation, Chatsworth, Calif.

[21] Appl. No.: 788,041

[22] Filed: Oct. 16, 1985

[51] Int. Cl.[4] ..... H01Q 1/32; H01Q 1/12

[52] U.S. Cl. ..... 343/715; 343/711; 343/713; 343/880; 343/888; 343/892

[58] Field of Search ..... 343/711, 713, 715, 880, 343/888, 892

[56] References Cited

U.S. PATENT DOCUMENTS

| | | | |
|---|---|---|---|
| 3,071,338 | 1/1963 | Kaufman et al. | 343/715 |
| 3,230,533 | 1/1966 | Brill | 343/713 |
| 3,943,524 | 3/1976 | Sample | 343/892 |
| 4,190,839 | 2/1980 | Liautaud | 343/715 |

*Primary Examiner*—Robert E. Wise
*Assistant Examiner*—D. Johnson
*Attorney, Agent, or Firm*—Marvin H. Kleinberg

[57] ABSTRACT

When a portable communication equipment such as a cellular telephone is carried inside an automotive vehicle, there is a need for its antenna to be supported exterior to the vehicle frame but at the same time be easily detachable from the vehicle.

The invention provides a mounting clamp assembly for removably supporting an antenna on the exterior side of a vehicle window, and includes circuit means extending over the top of the window for sending signals between the antenna and the equipment. The mounting clamp assembly is easily attached to or removed from the window and its operation does not interfere with either the operation of the electrical circuit or the opening or closing of the window.

12 Claims, 6 Drawing Figures

Fig. 3.
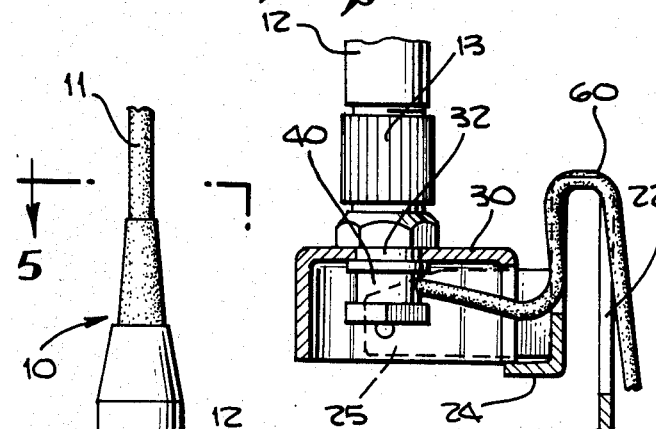
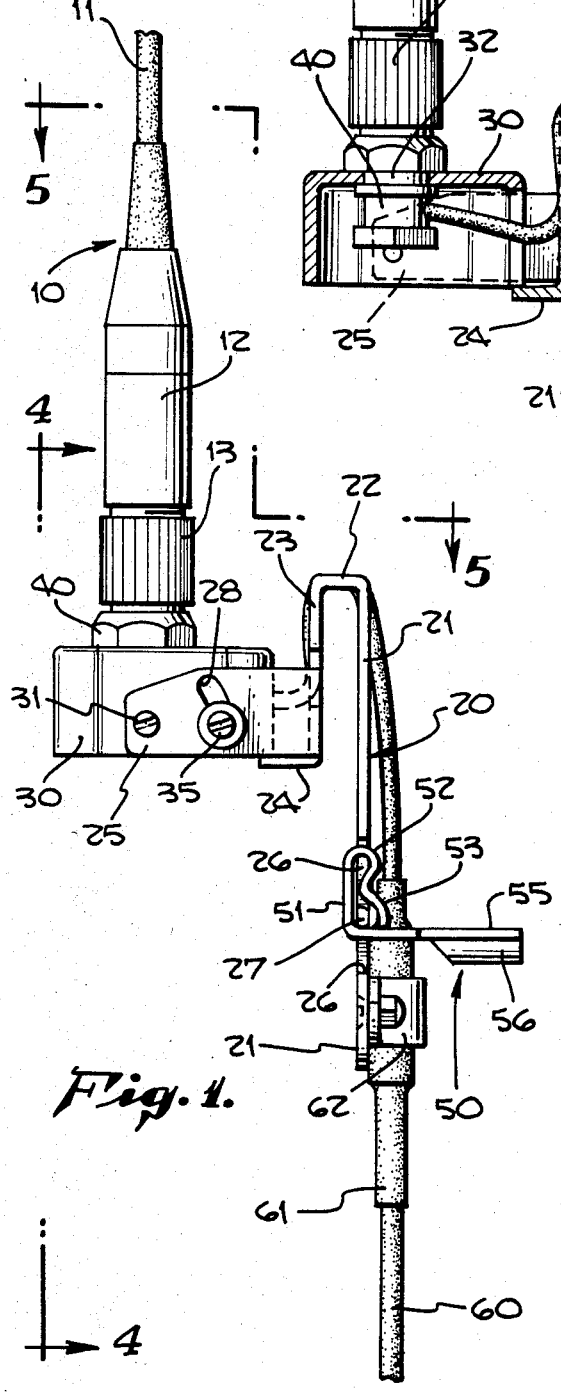
Fig. 1.
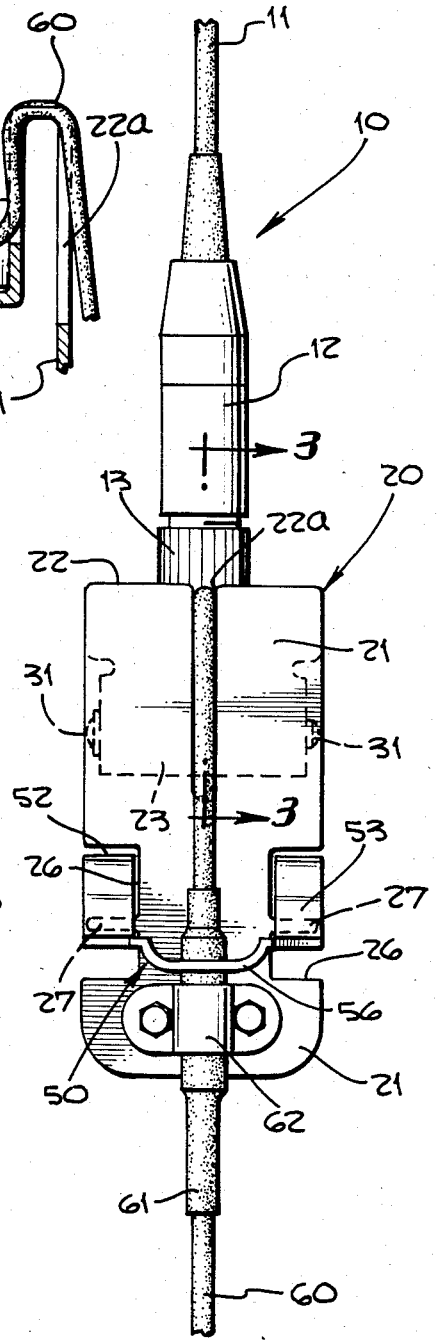
Fig. 2.

10
11
12
13
20
21
22
23
24
25
26
27
28
30
31
35
40
50
51
52
53
55
56
60
61
62
W

VEHICLE WINDOW MOUNT FOR PORTABLE ANTENNA

BACKGROUND OF THE INVENTION

The use of portable radio transmitting and receiving equipment is now commonplace. Some such equipments particularly cellular telephones, require an attached antenna.

When a cellular telephone is utilized inside an automotive vehicle, it is necessary that the antenna be supported on the exterior of the vehicle. If the antenna is placed inside the vehicle, it becomes ineffective, because the radio transmission is incapable of penetrating to the interior of the vehicle.

It has therefore been a practice to mount a fixed antenna on the exterior of a vehicle, when the vehicle is to be used for transporting a cellular telephone or other similar communication equipment.

SUMMARY OF THE INVENTION

According to the present invention a mounting clamp assembly is provided for removably attaching a communication antenna to the exterior of a window of a vehicle. More specifically, the mounting clamp assembly clamps over the top of the vehicle window and has associated circuit means interconnected between the antenna and a portable communcation equipment located inside the vehicle, but the circuit means is arranged so that it does not interfere either with the attachment of the clamp assembly to the window or its removal therefrom, or with the raising or lowering of the window.

Still more specifically, according to the present invention, a mounting clamp assembly is provided, such that a whip antenna can be mounted in substantially a vertical position on the exterior side of a vehicle window, the window can be raised to its fully closed position with the mounting clamp assembly still in place, and yet, when it is desired to remove the antenna with its associated communication equipment the window may be lowered and the mounting clamp assembly removed therefrom. The portable communcation equipment, including the antenna, may then be transported to some other location for further usage.

DRAWING SUMMARY

FIG. 1 is an elevation view of the mounting clamp assembly of the invention in its operative position while supporting an antenna;

FIG. 2 is another elevational view of the apparatus taken from the right hand side of FIG. 1;

FIG. 3 is a cross-sectional elevation view taken on the line 3—3 of FIG. 2;

DETAILED DESCRIPTION

Figures 4, 5, 6:
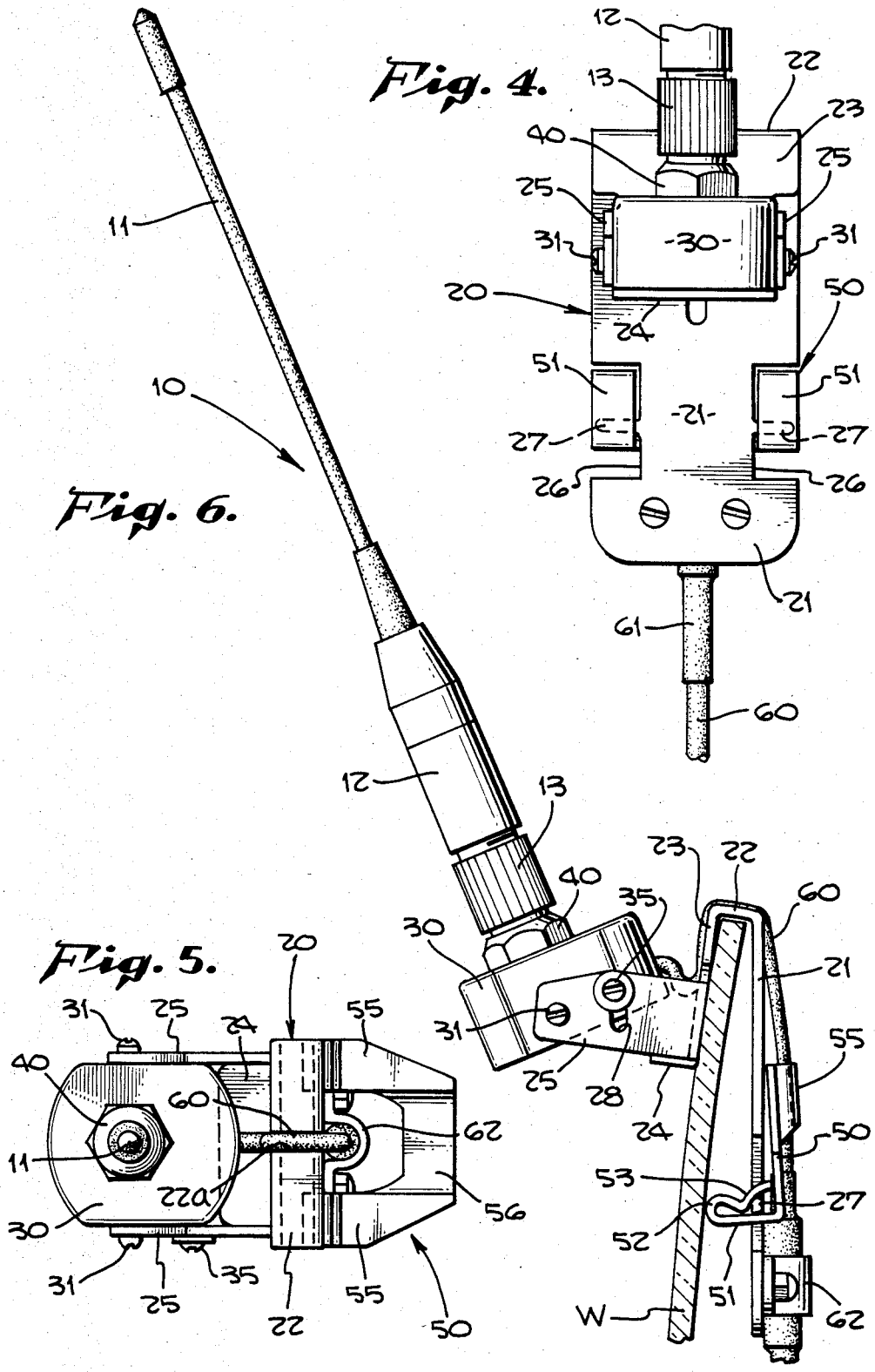
FIG. 4 is an elevation view taken on the line 4—4 of FIG. 1.
FIG. 5 is a horizontal cross-sectional view taken on the line 5—5 of FIG. 1.
FIG. 6 is an elevation view of the apparatus, showing in cross-section the upper portion of a window to which the mounting clamp assembly is attached, and also showing the antenna in a outwardly inclined position.

Reference is now made to FIGS. 1–6 of the drawings which illustrate the presently preferred embodiment of the invention.

A whip antenna 10, (FIGS. 1, 6,) has a rubber covered flexible upper extension 11 and a rigid metal base 12. The metal base 12 is of a standard type known as TNC, and has on its lower extremity a rotatable nut 13 for attachment of other circuit means thereto. Through the mounting clamp assembly of the present invention the antenna 10 is electrically connected to a communication equipment, not specifically shown in the present drawings.

The mounting clamp assembly of the present invention includes, as one of its main elements, a clamping frame 20. The clamping frame 20 consists of a resilient, flat metal plate which is bent into an essentially U-shaped configuration. More specifically, the frame 20 includes a plate section 21 forming the interior part of the frame, which is adapted to extend generally parallel to the interior wall surface of a window W, as seen in FIG. 6. Frame 20 also includes an upper rim portion 22 which fits over the upper edge of the window W. On the exterior of window W a plate section 23 extends downwardly, having a horizontal flange 24, (FIG. 1,) at its lower extremity. At the sides of the plate section 23 are a pair of side plates 25 which extend vertically, along respective side edges of the bottom flange 24.

A base member 30 has an inverted cup-shaped configuration, as seen in FIGS. 1 and 3. Screws 31 support the side walls of the base member 30 for pivotal movement within the side plates 25. Base member 30 has an opening 32 formed in a generally central location in its upper wall, as shown in FIG. 3. An electrical connector 40 extends through the opening 32 having a portion which projects above the base member 30 as well as a portion which projects into the hollow interior of the base member. The knurled nut 13 of antenna 10 is threadedly fastened to the connector 40 by means of threads not shown in the drawings.

Thus, base member 30 is normally in a horizontal position as shown in FIG. 1, and connector 40 secures the antenna 10 to the base member so that the antenna is generally disposed in a substantially vertical position. Upon pivoting or tilting the base member 30 relative to clamping frame 20, however the antenna 10 may if desired be made to tilt in an outward direction to maintain a substantially vertical orientation.

The interior plate section 21 of clamping frame 20 has cut-away side openings 26, as best seen in FIG. 4. Within each cut-away opening 26 a small segment of the plate is left to form an outwardly extending pin 27.

A latch member 50 is pivotally attached to the interior part 21 of clamping frame 20. Latch member 50 is formed from a flat plate that is intially cut into a generally U-shaped configuration. Each extremity of the plate 50 is turned at an angle of 90 degrees to form a latch arm 51, is further turned at the end of latch arm 51 to form a curved surface 52, and has a further portion 53 which is turned back upon the latch arm 51 as well as upon the main part of the latch member 50 to form a cavity at their juncture. These cavities associated with the latch member 50 capture corresponding ones of the pins 27 on the clamping frame 20.

As shown in FIG. 5, the main body portion of the latch member 50 is designated 55, and the joining portion at the base of the U is designated as 56. The joining portion 56 is not in the same plane as the flat portion 55 but is pressed outwardly in a curved configuration, for a reason that will later be explained.

The position of latch member 50 before any latching action is undertaken is shown in FIG. 1. As there shown, clamping frame sections 21 and 23 are vertically disposed, ready to be placed over the interior and exterior sides, respectively, of a window. The main body portion 55 of latch member 50 is horizontal, disposed at an angle of 90 degrees to the plate section 21. Latch arms 51 are vertically disposed, just inwardly of the plate section 21.

When the clamping frame 20 is placed over the window W, the upper section 22 of the clamping frame rests upon the upper edge of the window as shown in FIG. 6. The joining section 56 of latch member 50 is then pushed upward so that the latch member will pivot through an angle of 90 degrees. This action also causes the plate section 21 to resiliently spring away from the window W. The resulting position of the parts is shown in FIG. 6. It will be noted from FIG. 6 that the reverse bend in the leg 53 of the latch member is essential in order to capture the pin 27 adjacent the juncture of latch arm 51 with the latch member 50, in order to thereby push the plate section 21 horizontally outward relative to the window W.

The entire surfaces of frame 20 and latch member 50 are preferably covered with a thin coating of an elastomeric material as by dipping, in order to avoid any scratching or abrasive action. Thus, rounded surface 52 of each latch arm 51 engages the interior surface of window W with a measurable amount of friction. As clearly seen in FIG. 6, the latch member 50 pivots far enough so that latch arm 51 is pivoted somewhat more than 90 degrees relative to plate section 21 of the clamping frame 20, and at the same time makes an angle of less than 90 degrees with respect to the interior surface of window W. Thus, this acts as an over-the-center type of latch mechanism, which will reliably hold the clamping assembly of the present invention in its desired position.

A coaxial cable 60 extends from the communication equipment, not specifically shown, to the mounting clamp assembly of the present invention. A longitudinal section of the coaxial cable 60 is covered by a protective sheath 61, which in turn is secured by means of a small clamp 62 onto the lower portion of plate 21 below the cutaway openings 26, and also extends through the central opening of latch member 50. From the upper end of sheath 61 the coaxial cable extends up to the upper end of plate section 21 of the frame 20, and is then bent over and through a notch **22*a* formed in the plate section 22 so as to pass over the upper edge of window W. Cable 60 then extends downward over the plate section 23 and curves into a horizontal path before being connected to one side of the electrical connector 40, see FIGS. 3 and 6. The use of the notch 22*a* in plate section 22, see FIG. 2, permits the coaxial cable 60 to pass over the upper edge of window W without occupying any additional space; that is it occupies only the same space as is already occupied by the plate section 22, see FIG. 1**.

Because of the generally U-shaped configuration of latch member 50, the latch can be pivoted back and forth between its two extreme positions without interfering with the coaxial cable 60. Specifically, when in the latched position shown in FIG. 6, the curved joining portion 56 of the latch member extends around the cable 60, allowing the full necessary movement of the latch but without interfering with the cable.

It is also apparent from the illustration of FIG. 6 that the window W can be raised upward to its fully closed position, and in most if not all automobiles, the upper portion of clamping frame 20 and the associated section of the coaxial cable 60 will then be received in the upper window casement without in any way interfering with the closing action of the window.

One of the side plates 25 of clamping frame 20 has an arcuate slot 28 formed therein, see FIG. 6. A bolt or pin 35, FIG. 5, is passed through the slot 28 and secured to the associated side wall of base member 30. The horizontal flange 24 of clamping frame 30 prevents the antenna 10 from being tilted inwardly with respect to the vehicle, see FIG. 1. The slot 28 and pin 35 however, permit the antenna to selectively tilted outward by a few degrees, as may be desired. This is sometimes necessary because in many automobiles the side window, particularly the window adjacent the driver's seat, is slanted somewhat inwardly as it extends upwardly. At the same time it is desirable and perhaps necessary that the antenna 10 be aligned in a precisely vertical posiion in order to secure the full benefit of radio transmission available to it. Thus the base member 30 may be pivoted on the screws 31, and the frictional grip of bolt or pin 35 on the slot 28 will hold the antenna in the selected position of adjustment, which would normally be as nearly vertical as can be achieved.

It is pointed out that although the present invention has been shown and described with reference to a particular embodiment, nevertheless various changes and modifications, obvious to one skilled in the art to which the invention pertains, are deemed to lie within the purview of the invention.

What is claimed and desired to be secured by Letters Patent of the United States is:

1. A mounting clamp assembly adapted for removably mounting the antenna of a portable communication equipment onto the window of an automotive vehicle such that the antenna will be outside the metal frame of the vehicle while its output signal is delivered to the equipment inside the vehicle, said mounting clamp assembly comprising:

a clamping frame adapted to hook over the upper edge of the window, said clamping frame having depending interior and exterior parts;

a base member secured to said exterior part of said clamping frame;

means for fastening the antenna in a generally vertical position to said base member;

a latch member pivotally attached to said interior part of said frame, said latch member being pivoted between open and locked positions and in its locked position engaging the interior surface of the window so as to frictionally secure said frame upon the window;

a coaxial cable secured upon said frame interior part for connection to the equipment; and circuit means interconnecting said coaxial cable with the antenna but without interfering with the operation of either the window or said latch member.

2. Apparatus as in claim 1 wherein said base member is pivotally mounted on said frame for selectively inclining the antenna away from the window, whereby on a vehicle with an inwardly slanted window the antenna may be maintained in substantially a true vertical position.

3. Apparatus as in claim 1 wherein said clamping frame interior part is resiliently deformable, said latch member is pivotal to an over-center position so as to bias said frame interior part away from the window, and said latch member has a rounded end surface which engages the window.

4. A mounting clamp assembly for removably mounting the antenna of a portable communication equipment onto a window of an automobile such that the antenna will be outside the metal frame of the automobile while its output signal will be delivered via a coaxial cable to the equipment inside the automobile, said assembly comprising:

a clamping frame made of a resilient metal plate bent into a generally hook-shaped configuration so as to hook over the upper edge of the automobile window, the main portion of the plate being adapted to remain inside the window while the hook portion extends to the outside, and also having a pair of arms on the hook portion which project horizontally outward from the outside of the window;

a base member mounted between said arms for pivotal movement about an axis parallel to the window;

means for rigidly attaching the lower end of a coaxial whip antenna to said base member, whereby upon pivoting said base member the antenna may be selectively inclined outward relative to the window;

means for securing said base member in a selected position of pivotal adjustment;

a latch member pivotally attached to the lower end of said clamping frame and selectively pivotable to a raised over-center position in which it flexes the lower end of said frame away from the window, thereby frictionally retaining said frame upon the window; and means for securing a coaxial cable upon said clamping frame extending over the window and electrically connected to said attachment means, but without interfering with the pivotal movement of said latch member or the closing of the window.

5. An assembly for removably supporting an antenna from the exterior of an automobile, comprising a clamping frame adapted to hook over the upper edge of a window of the automobile, latch means on the interior part of said frame selectively operable for frictionally latching said frame to the window, means on the exterior part of said frame for supporting the antenna, and circuit means connected to said supporting means and extending partly over and partly through said clamping frame for delivering radio signals from the antenna into the interior of the automobile.

6. Apparatus as in claim 5 which further includes means pivotally securing said supporting means to said clamping frame, whereby the antenna may be selectively tilted outwardly relative to the automobile; said securing means being also adapted to frictionally retain the antenna in a selected tilted position.

7. In a mounting clamp assembly for removably mounting an antenna onto an automobile window, the combination comprising:

a resilient, flat metal plate bent into a clamping frame of essentially U-shaped configuration, including an interior part adapted to extend generally parallel to the interior surface of the window, an upper rim portion adapted to fit over the upper edge of the window, and an exterior plate section which is generally parallel to said interior part and is adapted to extend downwardly outisde the window and having horizontally outwardly extending supprt means at its lower extremity;

means for securing an antenna to said support means;

said interior part of said clamping plate having a pair of cut-away side openings in each of which there is a small segment left which forms an outwardly extending pin, said two pins being aligned on a common horizontal axis;

a latch plate cut into a generally U-shaped configuration forming parallel arms whose extremities are bent at an angle of 90 degrees from said plate, each of said arms being also bent back upon itself to form a curved outer end, each of said arms also forming a cavity for capturing one of said pins; and said arms being pivotally mounted on said pins, and said latch plate being pivotal through an angle of somewhat more that 90 degrees relative to said clamping frame so that said curved outer ends of said latch plate arms engage the inner surface of the window and thereby force said interior part of said clamping frame resiliently outward from the window, said latch plate then occupying an over-center position relative to said clamping frame and said curved outer ends of said latch plate engaging the window.

8. The apparatus of claim 7 wherein said latch member arms are covered with a thin coating of an elastomeric material.

9. The apparatus of claim 7 wherein said upper rim portin of said clamping frame has a central notch therein, and which further includes a coaxial cable extending through said notch so as to pass over the upper edge of the window.

10. An antenna assembly adapted to be removably mounted onto an automobile window, comprising:

a resilient, flat metal plate bent into a clamping frame of essentially U-shaped configuration, including an interior part adapted to extend downward generally parallel to the interior surface of the window, an upper rim portion adapted to fit over the upper edge of the window, and an exterior plate section which is generally parallel to said interior part and is adapted to extend downwardly in engagement with the exterior surface of the window;

a parallel pair of vertically disposed side plates supported from said exterior plate section of said clamping frame and extending away from the window;

a base member having a generally inverted cup-shaped configuration and being disposed between said side plates and having two separate walls disposed parallel to respective ones of said side plates;

an aligned pair of pivot pins carried by corresponding ones of said side plates and pivotally securing the corresponding walls of said base member;

a whip antenna extending above said base member, having on its lower end a metal connector which extends through a central opening in said base plate, said connector being also secured to said base plate;

a cable extending from one side of said connector beneath said base plate and hence through a side opening in said base plate and along the path of said upper rim portion of said clamping frame and thus over the window and into the interior of the vehicle;

an adjustable fastening screw securing one of said side plates to the associated wall of said base member; and a notch formed in one of said one side plate and said associated base plate wall, whereby the antenna may be tilted with respect to said pivot pins either toward or away from the window into a selected position of adjustment and secured there by means of said fastening screw.

11. Apparatus as in claim 10 wherein said upper rim portion of said clamping frame has a central notch therein, and wherein said cable extends through said notch over the upper edge of the window.

12. Apparatus as in claim 10 which further includes a latch member carried by the interior part of said clamping frame and operable for biasing the interior part of the clamping frame away from the window.

* * * * *